US007186150B1

(12) United States Patent
Boone

(10) Patent No.: US 7,186,150 B1
(45) Date of Patent: Mar. 6, 2007

(54) SPLIT KEY IN A PRESS-FIT CONNECTOR

(75) Inventor: Douglas Boone, Citrus Heights, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/261,728

(22) Filed: Oct. 27, 2005

(51) Int. Cl.
*H01R 13/64* (2006.01)

(52) U.S. Cl. ..... 439/680

(58) Field of Classification Search ..... 439/680, 439/677

See application file for complete search history.

(56) References Cited

U.S. PATENT DOCUMENTS

| | | | | |
|---|---|---|---|---|
| 4,275,944 | A | 6/1981 | Sochor | |
| 4,332,431 | A * | 6/1982 | Bobb et al. | 439/267 |
| 4,585,285 | A | 4/1986 | Martens | |
| 4,586,254 | A | 5/1986 | Ammon et al. | |
| 5,007,846 | A | 4/1991 | Ravid | |
| 5,112,231 | A * | 5/1992 | Harwath et al. | 439/60 |
| 5,211,459 | A | 5/1993 | Wu | |
| 5,386,346 | A | 1/1995 | Gleadall | |
| 5,797,762 | A | 8/1998 | Saito et al. | |
| 5,803,761 | A | 9/1998 | Mochizuki | |
| 6,099,328 | A * | 8/2000 | Nelson et al. | 439/101 |
| 6,159,052 | A * | 12/2000 | Meng et al. | 439/633 |
| 6,375,478 | B1 | 4/2002 | Kikuchi | |
| 6,379,193 | B1 * | 4/2002 | Fujii et al. | 439/680 |
| 6,425,773 | B2 | 7/2002 | Mosebach et al. | |
| 6,769,785 | B1 | 8/2004 | Herst et al. | |

* cited by examiner

*Primary Examiner*—Tho D. Ta
*Assistant Examiner*—Vanessa Girardi

(57) ABSTRACT

A connector comprises multiple electrically-conductive pins coupled along a line and a press-fit edge connector body intersected by a slot configured for insertion of the multiple pins. Multiple contacts are contained within the press-fit edge connector body and configured to engage and respectively electrically connect to the multiple pins. A web extends across the slot, separating the multiple pins and the multiple contacts into respective different-sized portions whereby the pin plurality is prevented from reversed installation.

17 Claims, 9 Drawing Sheets

SPLIT KEY IN A PRESS-FIT CONNECTOR

BACKGROUND

Press-fit connectors are used extensively in electronic units such as printed circuit adapters. Press-fit connectors eliminate the need to solder leads in place and may enable connectors to be attached on both sides of the printed circuit adapter or in a location that a wave solder device cannot be used.

Tools for inserting press-fit components such as connectors onto a printed circuit assembly are typically highly expensive and fragile due to the small, intricate structures that are manipulated. One problem with press-fit connectors, particularly with edge connectors, is possible breakage of tiny metal teeth that are configured to hold onto metal parts inside the press-fit connector when the connector is pushed into the board.

SUMMARY

In accordance with an embodiment of connector, multiple electrically-conductive pins are coupled along a line. A press-fit edge connector body is intersected by a slot configured for insertion of the multiple pins. Multiple contacts are contained within the press-fit edge connector body and configured to engage and respectively electrically connect to the multiple pins. A web extends across the slot, separating the multiple pins and the multiple contacts into respective different-sized portions whereby the pin plurality is prevented from reversed installation.

BRIEF DESCRIPTION OF THE DRAWINGS

Embodiments of the invention relating to both structure and method of operation may best be understood by referring to the following description and accompanying drawings.

DETAILED DESCRIPTION

Structures and tools for connecting small, detailed structures in electronic systems are developed that reduce cost, improve durability and reduce malfunctioning of both the electronic systems and associated tooling, and facilitate proper connection and alignment.

A connector and associated tooling prevents an electronic device from reversed connection. In an example embodiment, an edge connector is shown which holds a voltage regulator module in place for connection to a printed circuit adapter and prevents reversed installation of the voltage regulator module. The edge connector incorporates an offset key or web between contacts in a position offset from center within the edge connector slot so the arrangement of connection pins on the voltage regulator module prevent reversed installation into the edge connector.

The disclosed connector and associated insertion tooling results in savings of tooling cost, longer tool life, and better quality and performance in placing the connector, resulting in improved quality for fabricated electronic systems and products.

Figure 1A:
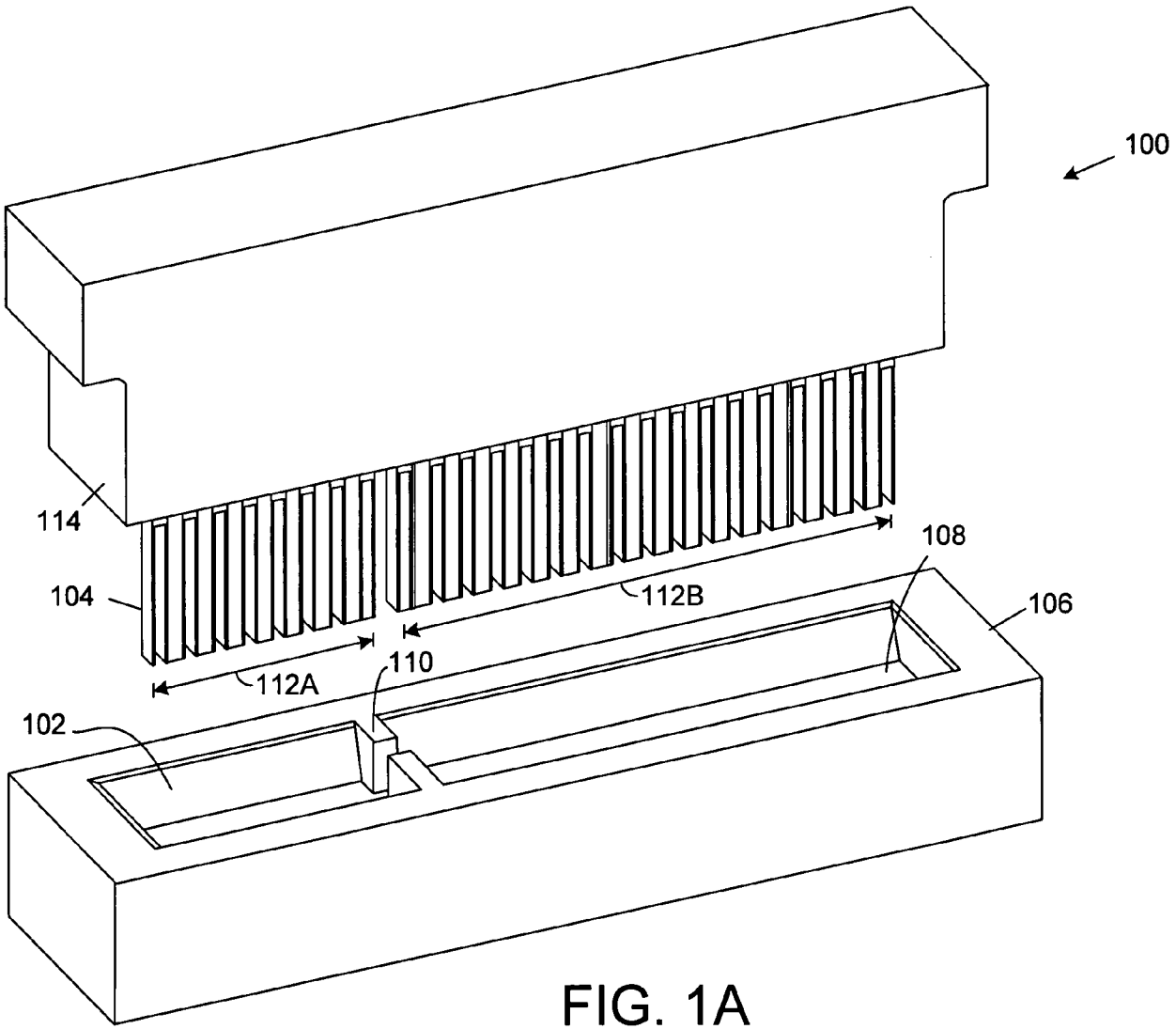
FIG. 1A is a perspective pictorial diagram illustrating an embodiment of a press-fit connector configured with a split key that prevents incorrect installation.

Referring to FIG. 1A, a perspective pictorial diagram illustrates an embodiment of a press-fit connector 100 configured with a split key 102 that prevents incorrect installation. The connector 100 comprises multiple electrically-conductive pins 104 coupled along a line. A press-fit edge connector body 106 is intersected by a slot 108 configured for insertion of the multiple pins 104. Multiple contacts are contained within the press-fit edge connector body 106 and configured to engage and respectively electrically connect to the multiple pins 104. A web 110 extends across the slot 108, separating the multiple pins 104 and the multiple contacts into respective different-sized portions 112A and 112B whereby the multiple pins 104 are prevented from reversed installation. The web 110 is intersected by a gap configured to receive an insertion tool structure whereby insertion pressure is applied to the multiple contacts and not the press-fit edge connector body 106.

A device body 114 is typically coupled to the multiple pin assembly 104 whereby the web 110 extending across the slot 108 prevents the device body 114 from reversed installation. In a particular example, the device body 114 may be a voltage regulator module that is coupled to a printed circuit board via the connector 100.

The press-fit edge connector body 106 is depicted as a through-hole connector body.

The illustrative web 110 is slotted with a gap 116 approximately in the center of the key or web 110. In a particular example, the gap 116 may have a length of approximately 0.02 to 0.03 inches, a size which facilitates usage of an insertion tool. In other examples, a gap may have any suitable length.

Figure 1B:
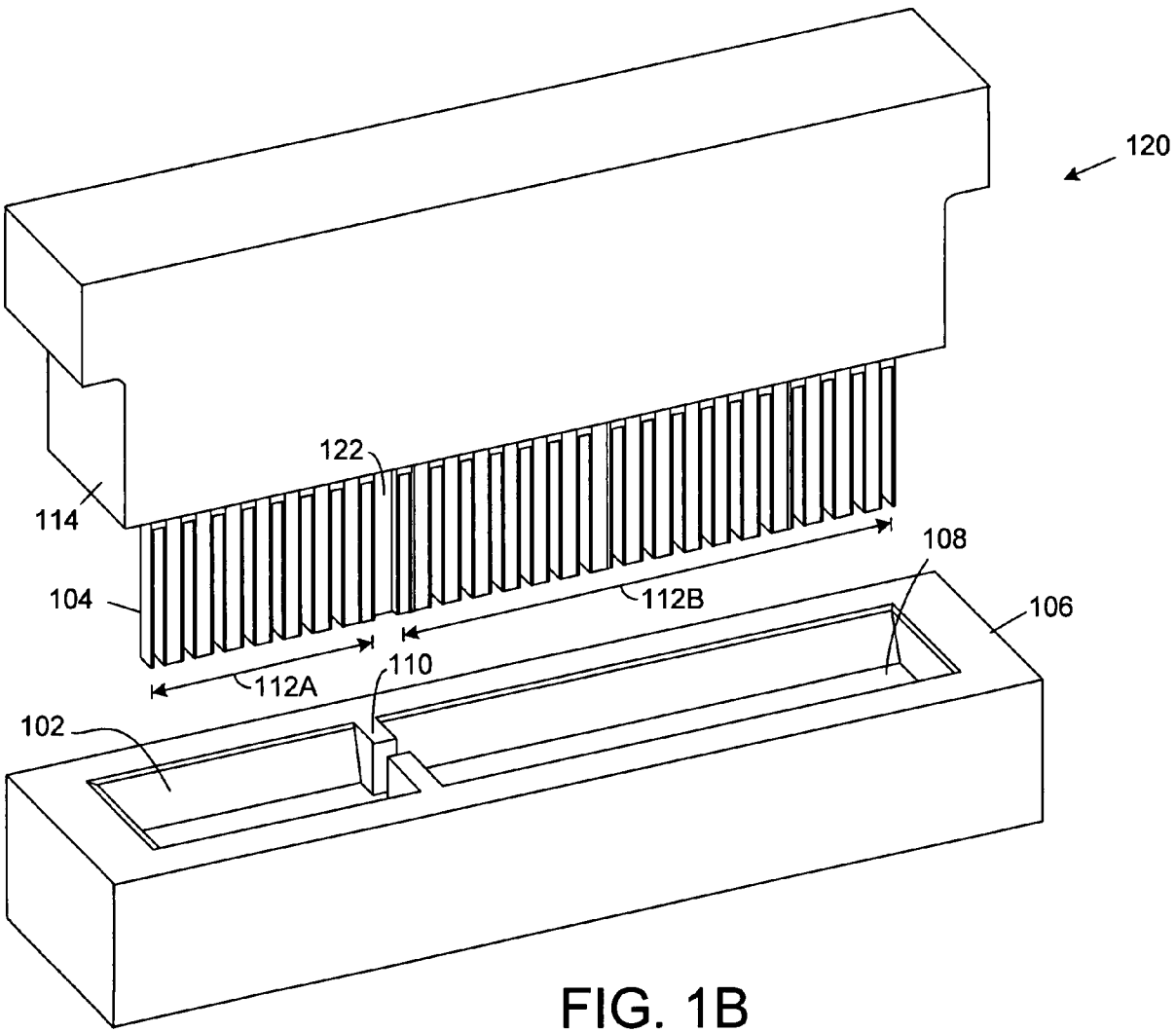
FIG. 1B is a perspective pictorial diagram illustrating an embodiment of a press-fit connector with a split key and a durable metal web to increase support for inserted pins.

Referring to FIG. 1B, a perspective pictorial diagram depicts an embodiment of a press-fit connector 120 with a split key 102 that prevents incorrect installation and also comprises a durable metal web 122 coupled between adjacent pins that straddle the web 110 extending across the slot 108. The durable metal web 122, for example constructed from steel or other material with suitable strength and fracture-resistance, is fastened to relatively delicate pins 104 to strengthen the connector 120.

In the illustrative example, the durable metal web 122 is a small web between pressure pins 104 adapted to hold the pins together and increase strength and durability. The slotted web 110 in combination with the durable metal web 122 reinforces and strengthens the relatively fragile pins 104, prevents the pins 104 from buckling, and creates a much stronger structure.

Introduction of the offset key to polarize the connector, for example with a piece of plastic that extends across the slot between contacts, may not leave sufficient space for teeth in the insertion tooling to avoid wear. The teeth are highly susceptible to breakage. Accordingly, the durable metal web 122 may be used to hold pins together and avoid snagging and wear that leads to breakage.

Figure 2A:
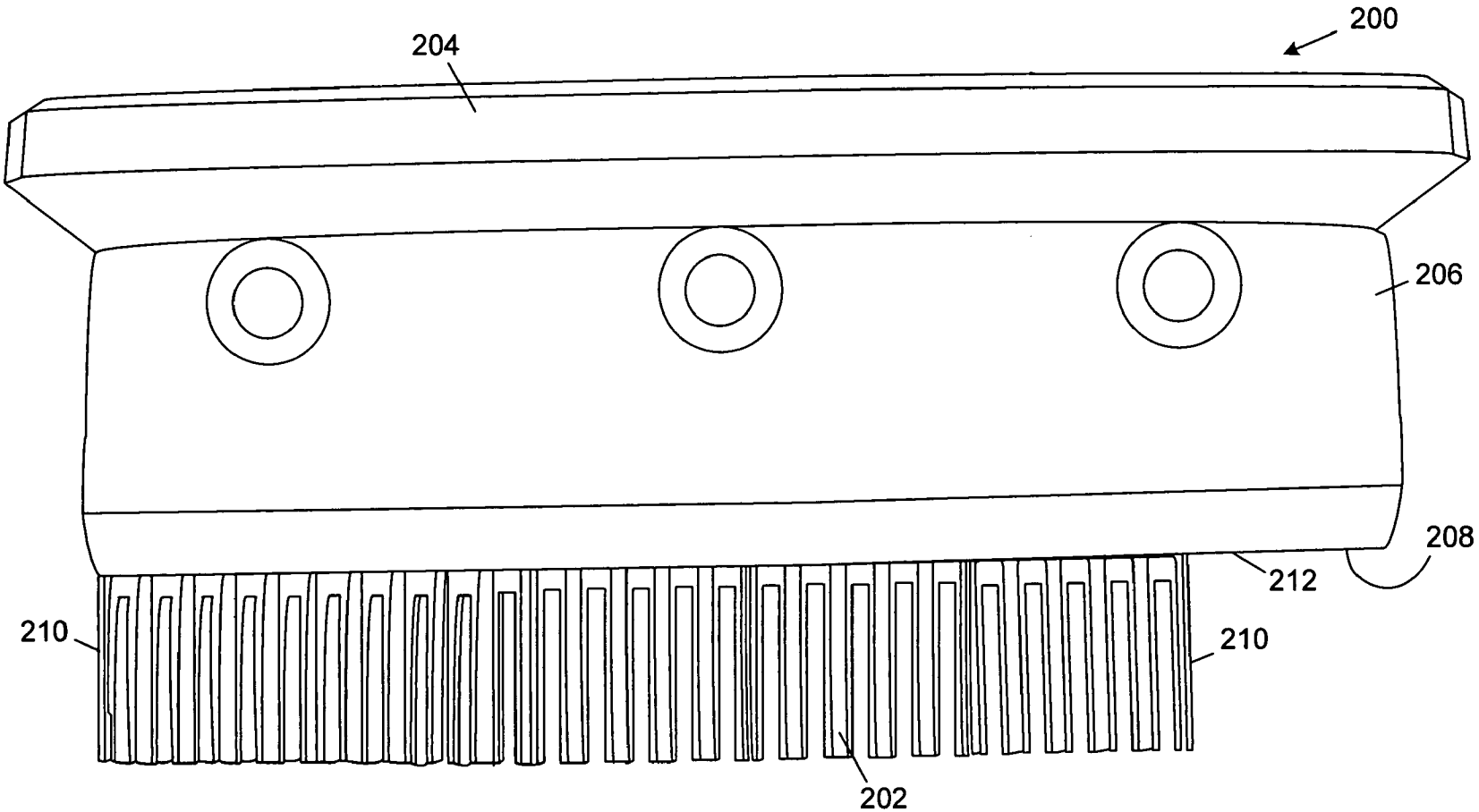
FIGS. 2A, 2B, and 2C are perspective pictorial diagrams showing various views of an insertion tool adapted to insert a device into a press-fit edge connector.
Figure 2B:
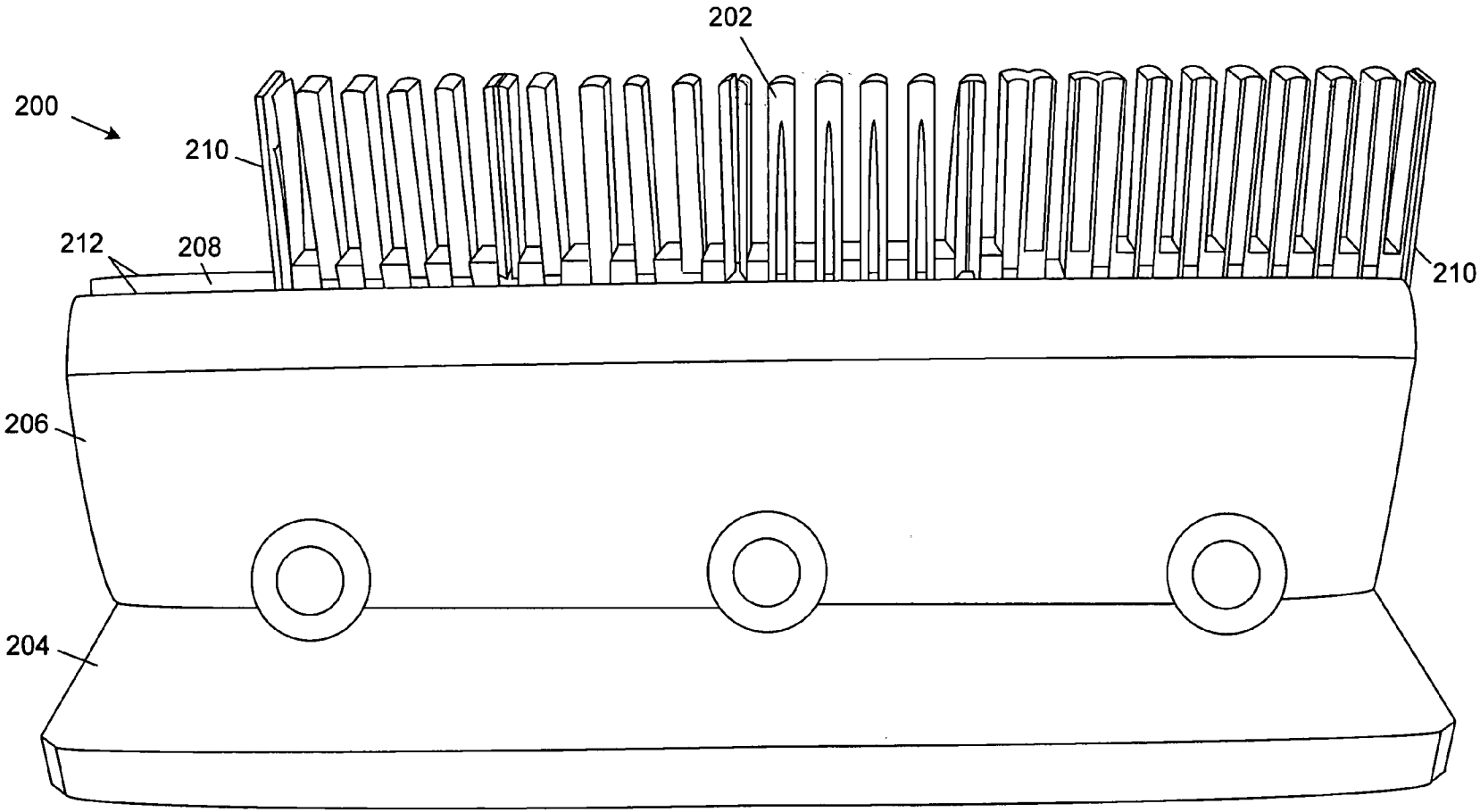
Figure 2C:
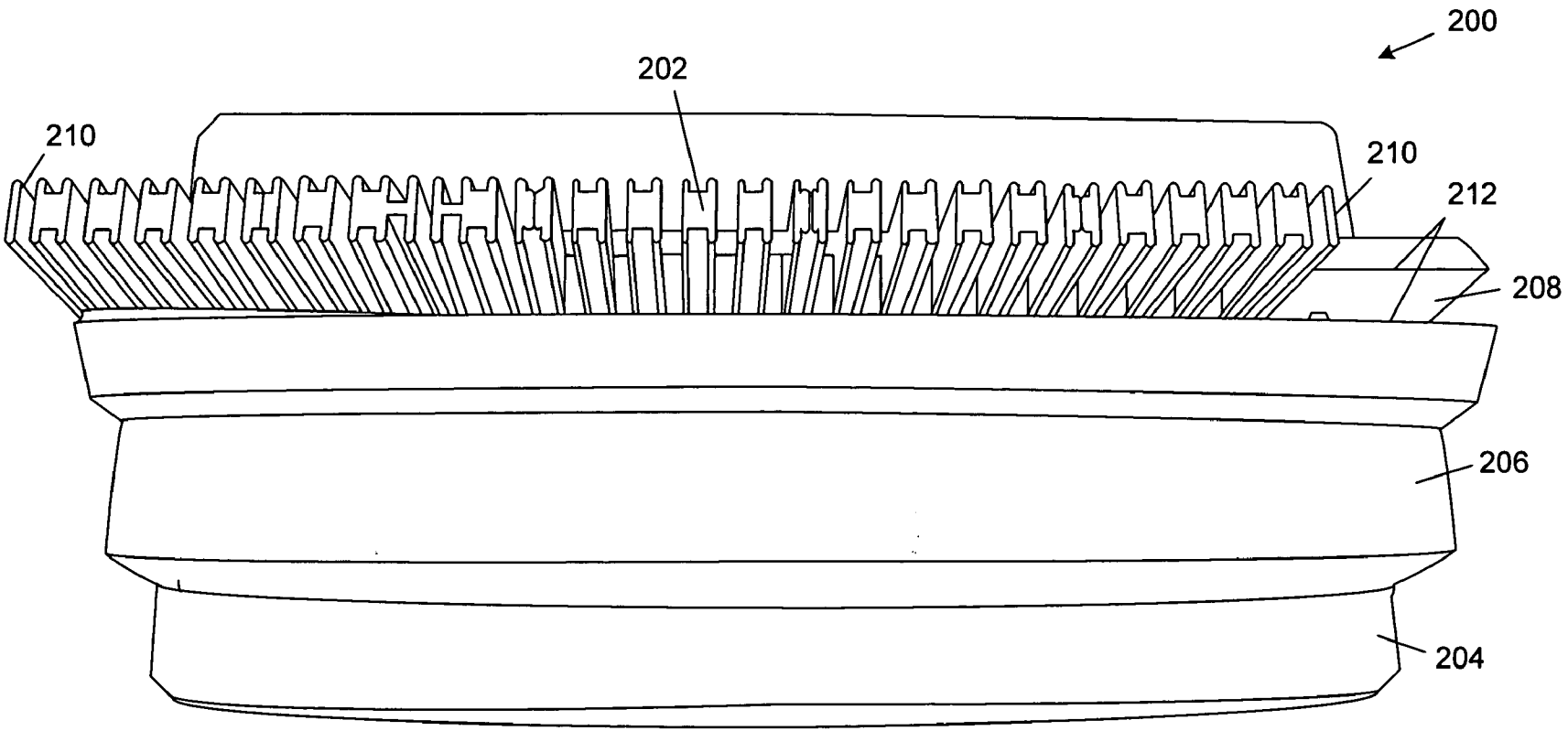

Referring to FIGS. 2A, 2B, and 2C, perspective pictorial diagrams illustrate various views of an insertion tool 200 that is adapted to insert a device 202 into a press-fit edge connector. FIG. 2A shows a side view of the insertion tool 200 and attached device 202. FIG. 2B illustrates a side view of the insertion tool 200 in an inverted orientation. FIG. 2C depicts a bottom view of the insertion tool 200. The insertion tool 200 comprises an insertion tool body 204 comprising a housing 206 with an interior cavity 208 configured to accept the device body. Durable support pins 210 are coupled to the insertion tool body 204 and configured for insertion into the slot. The insertion tool 200 is adapted to apply insertion pressure to the contact plurality and not the press-fit edge connector body.

A through-hole press-fit edge connector 100 as shown in FIG. 1A includes a web 110 which is slotted in a configuration that enables an edge of the insertion tool 200 to fit within the slot 108. When inserted, the insertion tool 200 directs application force to the pins and away from the press-fit connector body 106.

Figure 3A:
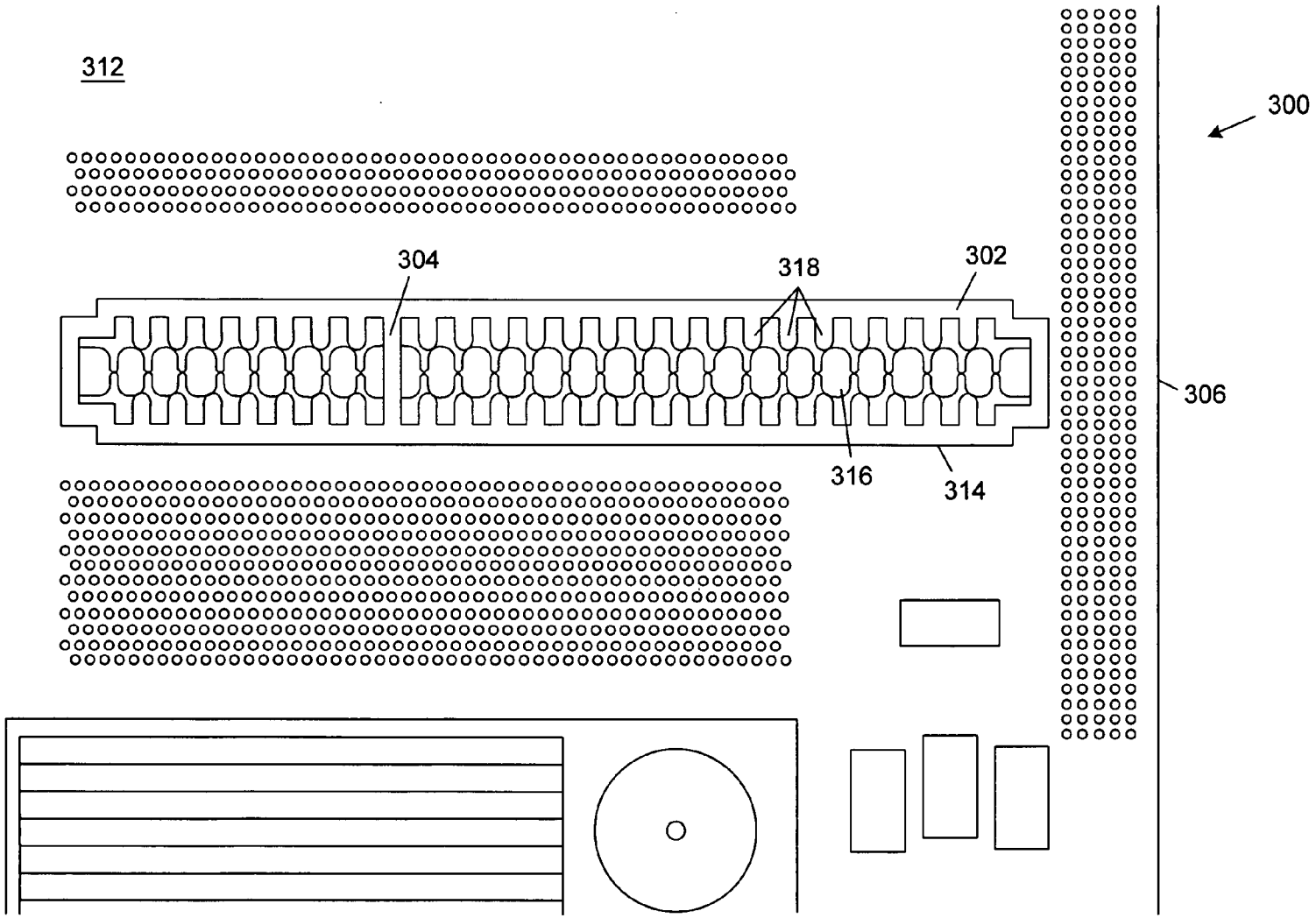
FIGS. 3A, 3B, and 3C are pictorial diagrams depicting an embodiment of an electronic apparatus incorporating a through-hole press-fit connector configured with an offset key that prevents incorrect installation.
Figure 3B:
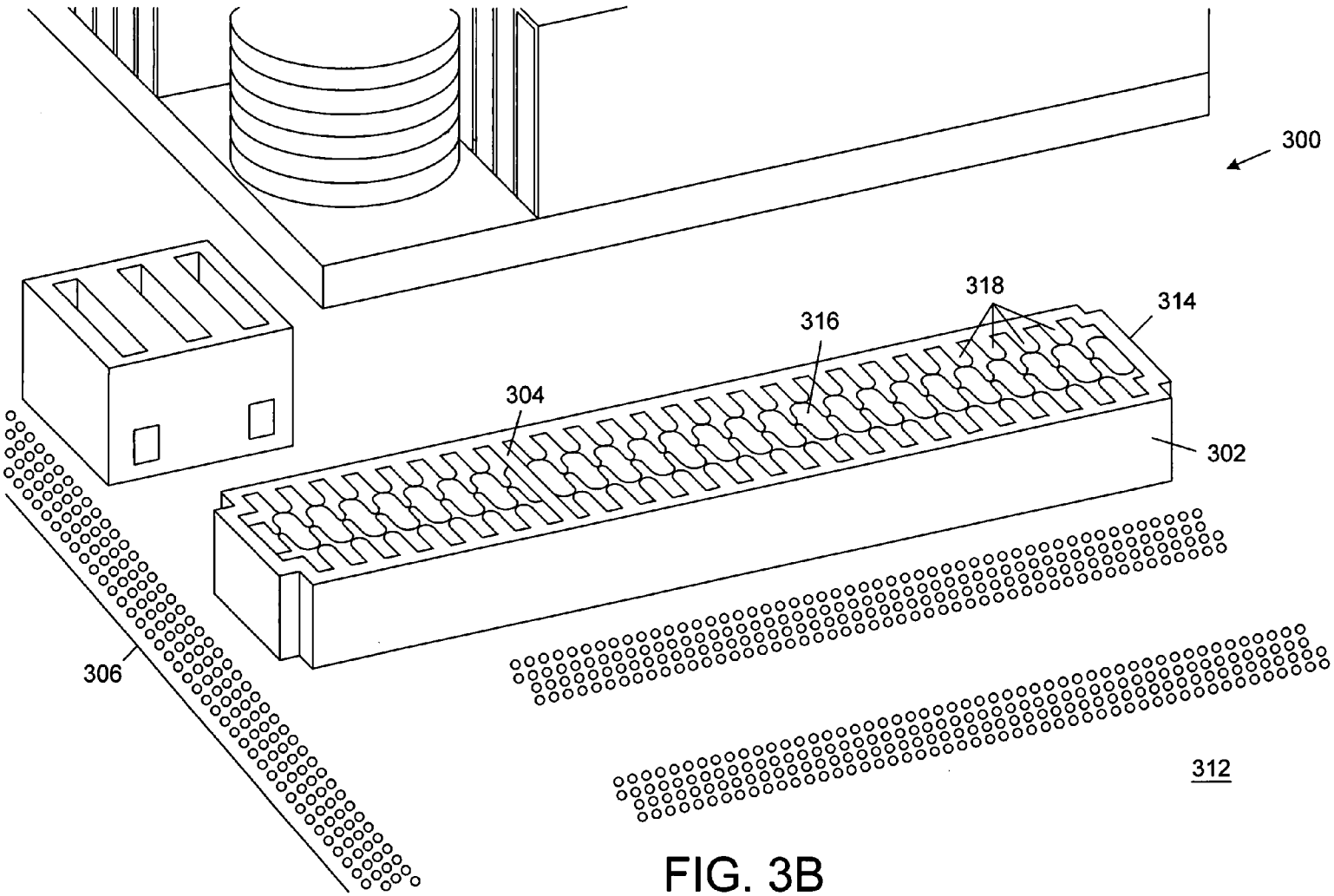
Figure 3C:
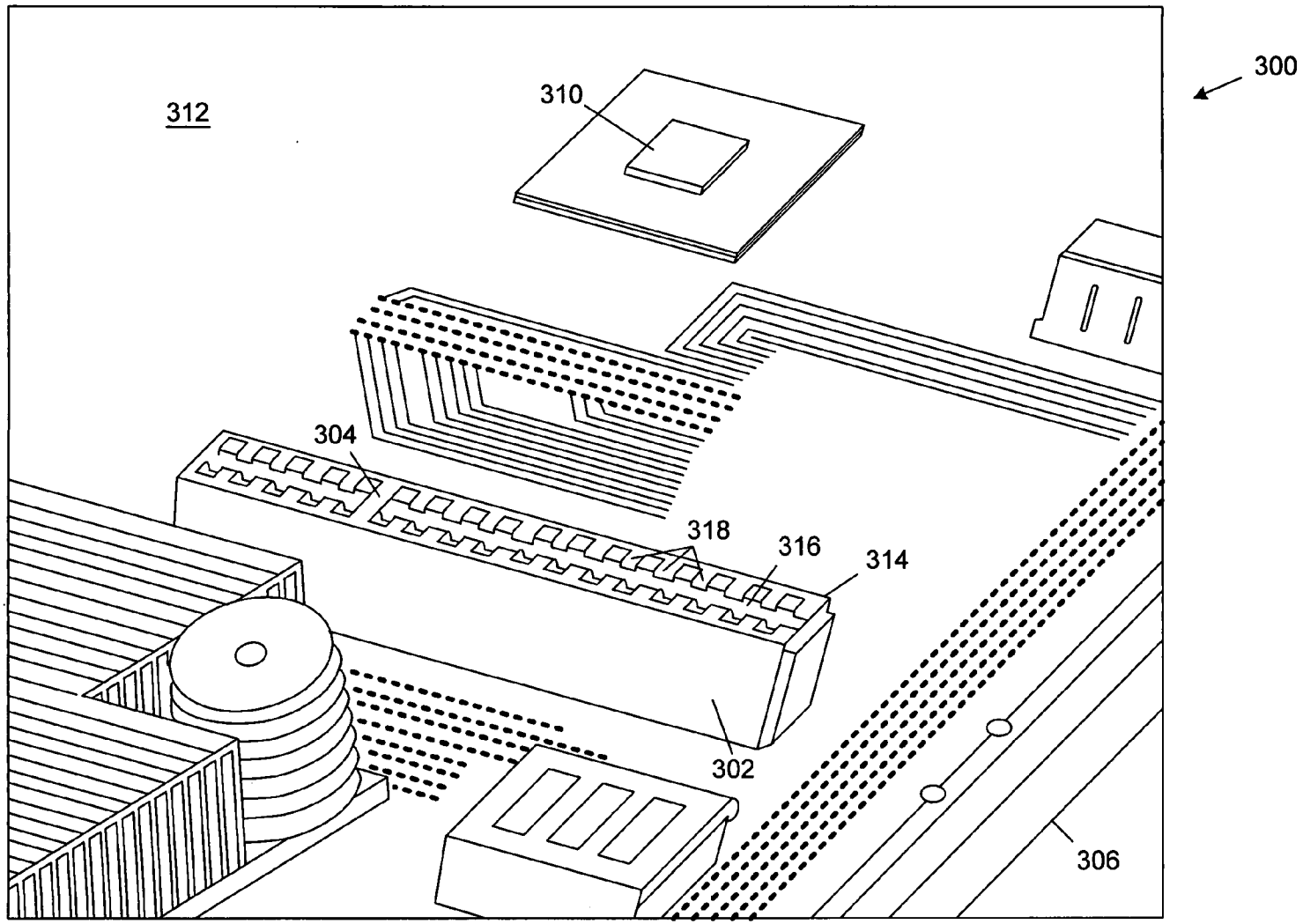

Referring to FIGS. 3A, 3B, and 3C, pictorial diagrams illustrate an embodiment of an electronic apparatus 300 incorporating a through-hole press-fit connector 302 configured with an offset key 304 that prevents incorrect installation. FIG. 3A shows an overhead view of the electronic apparatus 300. FIGS. 3B and 3C illustrate perspective views of the electronic apparatus 300 from generally opposite angles. The electronic apparatus 300 comprises a printed circuit board 306 and an electronic device adapted to interface to the printed circuit board 306. The electronic apparatus 300 further comprises a through-hole press-fit edge connector 302 which is adapted to physically and electrically connect the electronic device to the printed circuit board 306. The through-hole press-fit edge connector 302 further comprises the offset key 304 configured to polarize the electronic device/printed circuit board interface whereby a reverse connection is prevented. The offset key 304 is further configured to isolate insertion force to connector contacts during connection.

Figure 4:
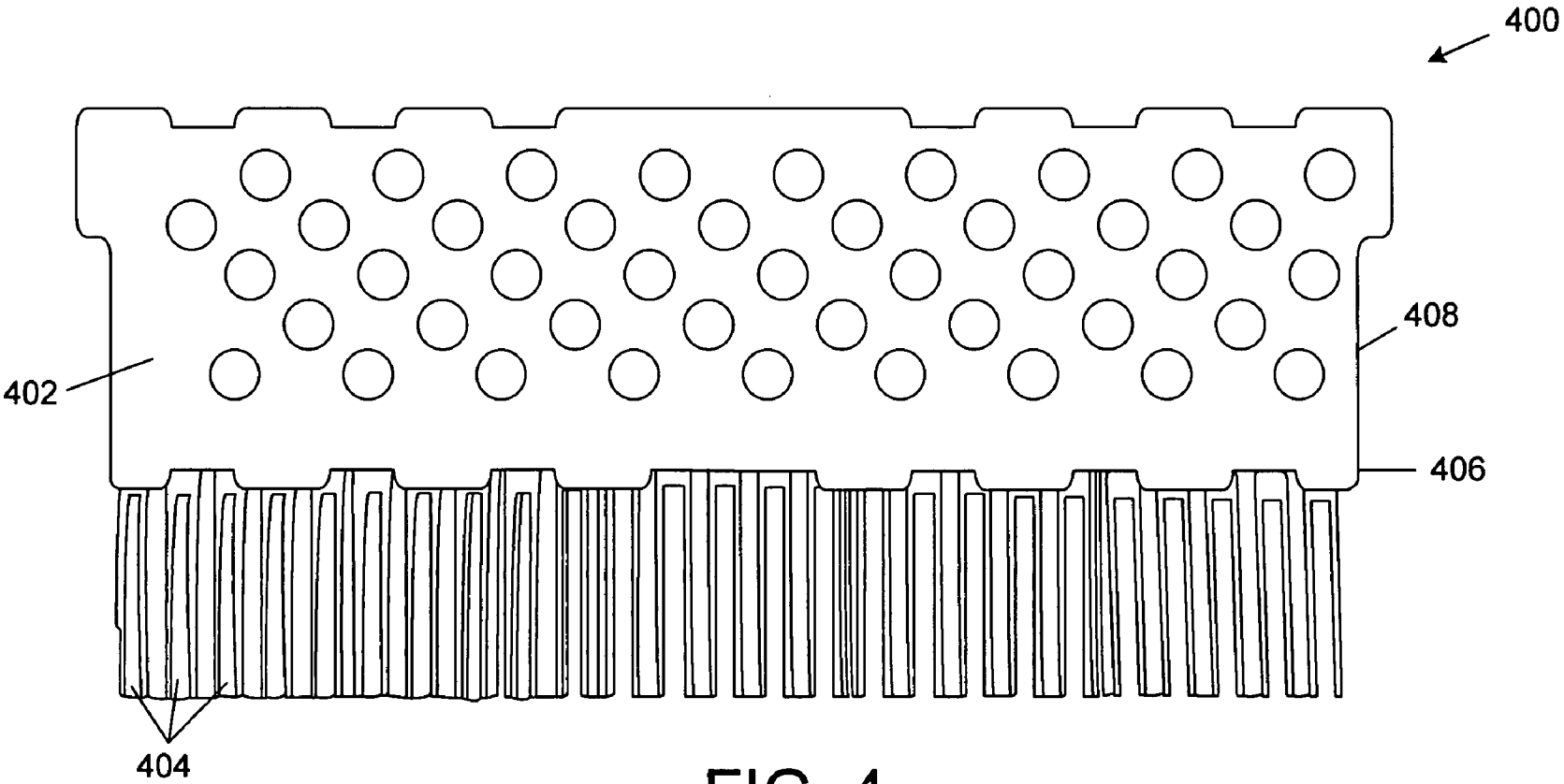
FIG. 4 is a pictorial diagram showing a side view of an electronic device adapted to connect to the through-hole press-fit connector.

In a specific embodiment, the electronic apparatus 300 may be a computer system comprising a processor 310 and a printed circuit adapter 312 configured to mount the processor 310. A voltage regulator module 400 shown in a pictorial diagram in FIG. 4 is adapted for attachment to the computer system 300. The through-hole press-fit edge connector 302 is adapted to connect the printed circuit adapter 312 and the voltage regulator module 400. The offset key 304 on the through-hole press-fit edge connector 302 polarizes the printed circuit adapter-voltage regulator module connection and prevents a reverse connection. The offset key 304 also isolates insertion force to connector contacts during connection.

In a particular example, the edge connector 302 has gold-plated finger contacts 318 within the slot 316. The offset key 304 may be implemented as a blocked piece of plastic that extends across the slot 316 at a right angle and polarizes the connector 302 so that an electronic device 400 cannot be inserted backwards. The particular example is a power supply connection to a DC-to-DC module. Reversed insertion of the electronic device may result in damage to destruction of the power supply. In other arrangements, a reversed connection can cause incorrect connection of signal lines. The offset key enables connection polarization. The illustrative embodiment may include a little thin web of steel between the two pins that secure the pins when the connector is inserted.

Referring to FIGS. 3A, 3B, and 3C in combination with FIG. 4, the electronic apparatus 300 further comprises a plurality of electrically-conductive pins 404 coupled along a line and coupled to an electronic device 402. A press-fit edge connector body 314 is intersected by a slot 316 configured for insertion of the pins 404. A plurality of contacts 318 are contained within the press-fit edge connector body 314 and configured to engage and respectively electrically connect to the plurality of pins 404. The offset key 304 extends across the slot 316 in a configuration that prevents the electronic device 402 from making a reverse connection to the press-fit edge connector body 314.

In a particular embodiment, the electronic device 402 may be a voltage regulator module. The offset key 304 extends across the slot 316 to prevent the voltage regulator module 402 from reverse connection to the press-fit edge connector body 314 and thus the printed circuit adapter 312.

In some embodiments, the electronic device 400 may include a durable metal support member coupled between adjacent pins that straddle the offset key 304. For example, a voltage regulator module may include a durable metal web that reinforces pins that engage the offset key such as the web 122 shown in FIG. 1B.

An insertion tool such as that shown in FIGS. 2A, 2B, and 2C is formed in an arrangement suitable for clasping the electronic device 400, for example a voltage regulator module. The electronic device 400 fits within the internal cavity 208 of the insertion tool body 204. The through-hole press-fit edge connector 302 is constructed in an arrangement in combination with the insertion tool whereby, during insertion, the insertion tool applies pressure to the pins 404 and not the electronic device body. In a specific embodiment, the insertion tool 200 contacts the electronic device 400 at the base of the pins 404, grasping the electronic device 400 to facilitate insertion of the pins 404 into the press-fit edge connector body slot. Some embodiments of the insertion tool 200 may include a durable support or web 210, adding strength and reinforcement to the pins 404.

The connector 302 for the voltage regulator module 400 is a through-hole part that is set in holes in the printed circuit board 306 and wave soldered into place. With the press-fit connector 302, the insertion tool 200 is to be inserted in the edge connector slot 316 that pushes on the contacts 318 in the connector 302 and allows the voltage regulator module 400 to be forced into place on the printed circuit adapter 312. The connector assembly and insertion tool 200 are configured so that pressure or force applied during insertion is applied to the contacts 318 and not the connector body 314 to avoid pushing the contacts 318 out of the body 314.

In an arrangement with the web 304 extending completely across the edge connector slot 316 as shown in FIGS. 3A, 3B, and 3C, an insertion tool inserts the pins by pressing on the contacts 318. An insertion tool capable of pushing on the contacts while avoiding interference with the web 304 is constrained to be very fine and intricate. Thus, the detail of the insertion tool may be easily broken and difficult to fabricate, resulting in a tool that is very expensive and has a short service life. Small size and high complexity of the tool increases the difficulty of seeing the condition of the contact and determining whether the tool is broken. Small parts of the tool can break off and cause short-circuiting. The connection contact can be damaged and the quality of the interconnect compromised.

To increase durability and reduce tooling cost, the web 110 may be slotted as shown in FIGS. 1A and 1B so that the insertion tool fits in the slot 108 and facilitates the ability of the tool to press on the contacts. The slotted web 110 also enables usage of a standard or only slightly modified tool. Accordingly, the slotted web 100 may reduce tooling cost, extend tool life, and enhance supportability at an assembly facility. In a particular example, a one-piece standard tool in accordance with the illustrative insertion tool 200 may be implemented in place of a standard four-piece tool at a cost reduction of more than ninety percent, and a substantial reduction in tool servicing and replacement.

The through-hole press-fit connector 302 enables a method of connecting devices in an electronic system that prevents reversed connection of the electronic device 402. The connector system is constructed by arranging the set of electrical contacts 318 in a strip. The through-hole press-fit edge connector body 314 is formed, for example by molding, and split longitudinally by the internal slot 316. The through-hole press-fit edge connector body 314 is constructed in a form suitable for receiving a strip of contact pins in a press-fit connection. The through-hole press-fit edge connector body 314 is formed to incorporate the offset key 304 in the slot 316 between selected electrical contacts whereby the offset key 304 prevents reversed connection of the contact pin strip. A gap is formed intersecting the offset key 304 enabling receipt of an insertion tool structure whereby insertion pressure is applied to the contact set and not the press-fit edge connector body.

The electrical contacts strip 318 is within the through-hole press-fit connector body 314, typically by insertion into the body 314 and clipping into place using tabs, although other fixing hardware may be used.

The electronic device 402 is typically formed by lay out and construction of a substrate, for example a circuit board, with patterned conductive tracings. The substrate is laid out taking into consideration particular components for mounting of the substrate. Components are generally attached to the substrate using a suitable technique such as solder reflow. In the illustrative example, the electronic device 402 is shown covered with a shield to manage electromagnetic interference. A set of conductive pins 404 is arranged in a strip and physically and conductively connected to the electronic device. The line of attachment 406 between the pin strip 404 and the electronic device body 408 is generally a relatively durable portion of the device 402.

The insertion tool 200 may be constructed by forming, for example by molding, the insertion tool body 204 which is split longitudinally by the internal cavity 208. The internal cavity 208 has a size and shape appropriate for receiving the electronic device 402. The housing 206 may be constructed with durable edges 212 on the insertion tool body 204 adapted to grasp the pin strip 404 and apply insertion force predominantly to the pin strip and relatively less to the insertion tool body.

The insertion tool 200 is used to force the electronic device 402 into the slot 316. The electronic device 402 is enclosed within the insertion tool internal cavity 208 with the pin strip 404 extending outward from the insertion tool body 204. The insertion tool 200 is closed onto the electronic device 402 with the durable edges 212 grasping the pin strip 404. Grasping the pin strip 404 along the line of attachment 406 between the pin strip 404 and the electronic device body 408 enables a secure hold that reduces the chance of pin breakage. The pin strip 404 is inserted into the slot by application of pressure using the insertion tool 200 predominantly to the electrical contacts 318 and relatively less to the through-hole press-fit connector body 314.

While the present disclosure describes various embodiments, these embodiments are to be understood as illustrative and do not limit the claim scope. Many variations, modifications, additions and improvements of the described embodiments are possible. For example, those having ordinary skill in the art will readily implement the steps necessary to provide the structures and methods disclose herein, and will understand that the process parameters, materials, and dimensions are given by way of example only. The parameters, materials, and dimensions can be varied to achieve the desired structure as well as modifications, which are within the scope of the claims. Variations and modifications of the embodiments disclosed herein may also be made while remaining within the scope of the following claims. For example, the illustrative structures and techniques may be implemented as various types of connectors, connecting any suitable types of electronic devices. Similarly, the disclosed connector and insertion tools may be adapted for usage with any appropriate types of electronics or computer systems.

What is claimed is:

1. A connector apparatus comprising:

a plurality of electrically-conductive pins coupled along a line;

a press-fit edge connector body intersected by a slot configured for insertion of the pin plurality;

a plurality of contacts contained within the press-fit edge connector body and configured to engage and respectively electrically connect to the pin plurality; and a web extending across the slot that separates the pin plurality and the contact plurality into respective different-sized portions whereby the pin plurality is prevented from reversed installation, the web intersected by a gap configured to receive an insertion tool structure whereby insertion pressure is applied to the plurality of electrically-conductive pins and not the press-fit edge connector body; and a durable metal web coupled between adjacent pins that straddle the web of the connector body.

2. The apparatus according to claim 1 wherein:

the press-fit edge connector body is a through-hole connector body.

3. The apparatus according to claim 1 further comprising:

a device body coupled to the pin plurality whereby the web extending across the slot prevents the device body from reversed installation.

4. The apparatus according to claim 1 further comprising:

an insertion tool comprising:

an insertion tool body comprising a housing with an interior cavity configured to accept the device body; and durable support pins coupled to the insertion tool body and configured for insertion into the slot, the insertion tool being adapted to apply insertion pressure to the contact plurality and not the press-fit edge connector body.

5. An electronic apparatus comprising:

a printed circuit board;

an electronic device adapted to interface to the printed circuit board; and a through-hole press-fit edge connector comprising:

a plurality of electrically-conductive pins coupled along a line and coupled to the electronic device;

a press-fit edge connector body intersected by a slot configured for insertion of the pin plurality;

a plurality of contacts contained within the press-fit edge connector body and configured to engage and respectively electrically connect to the pin plurality; and an offset key extending across the slot in a configuration that prevents the electronic device from reverse connection to the press-fit edge connector body, the offset key intersected by a gap configured to receive an insertion tool structure whereby insertion pressure is applied to the plurality of electrically-conductive pins and not the press-fit edge connector body;

a durable metal support member coupled between and reinforcing adjacent pins of the pin plurality that straddle the offset key.

6. The apparatus according to claim 5 further comprising:

the through-hole press-fit edge connector adapted to physically and electrically connect the electronic device to the printed circuit board, the through-hole press-fit edge connector further comprising an offset key configured to polarize the electronic device to printed circuit board interface whereby a reverse connection is prevented, the offset key further configured to isolate insertion force to connector contacts during connection.

7. The apparatus according to claim 5 wherein:

the through-hole press-fit edge connector is configured in combination with an insertion tool whereby, during insertion, the insertion tool applies pressure to the pins and not the electronic device.

8. The apparatus according to claim 5 further comprising:

an insertion tool adapted to grasp the electronic device for insertion of the pin plurality into the slot of the press-fit edge connector body; and at least one durable web coupled to the insertion tool and configured to support selected ones of the pin plurality.

9. A computer system comprising:

a processor;

a printed circuit adapter configured to mount the processor;

a voltage regulator module; and a through-hole press-fit edge connector comprising a plurality of electrically-conductive pins coupled along a line and coupled to the voltage regulator module;

a press-fit edge connector body intersected by a slot configured for insertion of the pin plurality;

a plurality of contacts contained within the press-fit edge connector body and configured to engage and respectively electrically connect to the pin plurality; and an offset key extending across the slot in a configuration that prevents the voltage regulator module from reverse connection to the press-fit edge connector body, the offset key intersected by a gap configured to receive an insertion tool structure whereby insertion pressure is applied to the plurality of electrically-conductive pins and not the press-fit edge connector body; and a durable metal web coupled between and reinforcing pins of the voltage regulator module that engage the offset key.

10. The computer system according to claim 9 further comprising:

the through-hole press-fit edge connector adapted to connect the printed circuit adapter and the voltage regulator module, the through-hole press-fit edge connector further comprising an offset key configured to polarize the printed circuit adapter-voltage regulator module connection whereby a reverse connection is prevented, the offset key further configured to isolate insertion force to connector contacts during connection.

11. The computer system according to claim 9 wherein:

the through-hole press-fit edge connector is configured in combination with an insertion tool whereby, during insertion, the insertion tool applies pressure to the pins and not the voltage regulator module.

12. The computer system according to claim 9 further comprising:

an insertion tool adapted to grasp the voltage regulator module for insertion of the pin plurality into the press-fit edge connector body slot via application of pressure to the pin plurality and not the voltage regulator module; and at least one durable support coupled to the insertion tool and configured to support selected one of the pin plurality.

13. The computer system according to claim 9 further comprising:

a web coupled to the through-hole press-fit edge connector whereby the web is slotted in a configuration that accepts an insertion tool and directs insertion tool application force to the pins and away from the press-fit edge connector body.

14. A method of connecting devices in an electronic system comprising:

arranging a set of electrical contacts in a strip;

forming a through-hole press-fit edge connector body split longitudinally by an internal slot adapted to receive a strip of contact pins in a press-fit connection;

incorporating an offset key in the slot between selected electrical contacts whereby the offset key prevents reversed connection of the contact pin strip;

forming a gap intersecting the offset key in a configuration for receiving an insertion tool structure whereby insertion pressure is applied to the strip of contact pins and not the press-fit edge connector body; and encasing the electrical contacts strip within the through-hole press-fit connector body;

reinforcing the contact pins at the offset key with a durable metal web coupled between said contact pins.

15. The method according to claim 14, further comprising:

arranging a set of conductive pins in a strip;

forming an electronic device; and physically and conductively connecting the electronic device to the pin strip.

16. The method according to claim 15 further comprising:

forming an insertion tool body split longitudinally by an internal cavity adapted to receive the electronic device; and forming durable edges on the insertion tool body adapted to grasp the pin strip and apply insertion force predominantly to the pin strip and relatively less to the insertion tool body.

17. The method according to claim 16 further comprising:

enclosing the electronic device within the insertion tool internal cavity with the pin strip extending outward from the insertion tool body;

grasping the pin strip via the durable edges on the insertion tool body;

inserting the pin strip into the slot via application of pressure by the insertion tool predominantly to the electrical contacts and relatively less to the through-hole press-fit connector body.

* * * * *

UNITED STATES PATENT AND TRADEMARK OFFICE

CERTIFICATE OF CORRECTION

PATENT NO. : 7,186,150 B1
APPLICATION NO. : 11/261728
DATED : March 6, 2007
INVENTOR(S) : Douglas Boone It is certified that error appears in the above-identified patent and that said Letters Patent is hereby corrected as shown below:

In column 3, line 57, after "damage" delete "to" and insert -- or --, therefor.

In column 7, line 32, in Claim 9, after "comprising" insert -- : --.

Signed and Sealed this

Twenty-ninth Day of December, 2009

David J. Kappos

David J. Kappos
*Director of the United States Patent and Trademark Office*